US012241334B2

(12) United States Patent
Rejepov et al.

(10) Patent No.: US 12,241,334 B2
(45) Date of Patent: Mar. 4, 2025

(54) UNIDIRECTIONAL CEMENTING BASKETS FOR CEMENT TOP JOBS

(71) Applicant: SAUDI ARABIAN OIL COMPANY, Dhahran (SA)

(72) Inventors: Dautmammet Rejepov, Abqaiq (SA); Syed Muhammad Ali, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 10 days.

(21) Appl. No.: 18/319,335

(22) Filed: May 17, 2023

(65) Prior Publication Data

US 2024/0384622 A1 Nov. 21, 2024

(51) Int. Cl.
*E21B 33/136* (2006.01)
*E21B 33/14* (2006.01)

(52) U.S. Cl.
CPC ..... *E21B 33/136* (2013.01); *E21B 33/146* (2013.01); *E21B 2200/05* (2020.05)

(58) Field of Classification Search
CPC ..... E21B 33/13; E21B 33/136; E21B 33/14; E21B 33/146; E21B 2200/05
See application file for complete search history.

(56) References Cited

U.S. PATENT DOCUMENTS 3,119,451 A 1/1964 Hall
4,487,263 A 12/1984 Jani
6,851,477 B2 2/2005 Hill, Jr. et al.
6,942,039 B2 9/2005 Tinker
7,798,235 B2 9/2010 Mondelli et al.
10,711,581 B2 7/2020 Ning et al.
11,391,117 B2 7/2022 Acosta et al.
2010/0051276 A1 3/2010 Rogers et al.
2010/0163241 A1 7/2010 Klatt et al.
2014/0096963 A1* 4/2014 Sharma ..... E21B 33/13 166/278

FOREIGN PATENT DOCUMENTS

BR PI0400320 B1 9/2014

OTHER PUBLICATIONS

"RDE Technology: Float Subs;" Accessed May 16, 2023; Retrieved from the Internet: URL: http://www.rdetechnology.com/?page_id=1633 (1 page).

* cited by examiner

*Primary Examiner* — Dany E Akakpo
(74) *Attorney, Agent, or Firm* — Osha Bergman Watanabe & Burton LLP

(57) ABSTRACT

A downhole tool includes a support ring having an annular-shaped body, a thickness measured between an uphole side of the body and an opposite downhole side of the body, an extension distance measured between an inner diameter of the body and an outer diameter of the body, and one or more openings formed through the thickness of the body. A one-way valve is disposed in each opening formed through the support ring to limit flow through the support ring in a direction from the downhole side of the body to the uphole side of the body.

16 Claims, 5 Drawing Sheets

UNIDIRECTIONAL CEMENTING BASKETS FOR CEMENT TOP JOBS

BACKGROUND

Conventional well construction practice includes lowering casing into a drilled borehole of a well and cementing the casing in place to isolate the well from the surroundings. After a casing is lowered into and positioned in a well, the casing is cemented in place by pumping a cement slurry through the annulus between the casing and either the well open hole or a previously installed casing and allowing the cement to set.

When a primary cement job fails to fill cement around the top of the casing (e.g., when cement is lost into the surrounding formation or other reason not enough cement is pumped through the annulus), cement may be pumped into the top (uphole) portion of the annulus in a secondary cementing process, e.g., through a secondary injection point, to ensure good cementing. Such secondary cementing processes are often referred to as a "top job" or "top cement job."

Cementing baskets are simple and economical tools used in low-differential pressure applications to aid in support of the hydrostatic head of the cement slurry for top job cement applications. Typically, conventional cement baskets are used for primary cement jobs with total losses or expected total losses. An example of a cementing system 100 and process using a typical cement basket 110 is illustrated in FIG. 1. The cement basket 110 is positioned around the outer surface of a casing 120 being installed in the well 101. The cement basket 110 has a funnel-shaped barrier 112 that extends upward and radially outward from a collar fixed around the casing 120 toward the well wall 102 (which may be an open borehole or a previously installed casing). In such manner, the barrier 112 may create an upside-down umbrella to hold cement 130 within the annulus 104 between the casing 120 and the well wall 102. The barrier 112 may be made of a thin metal or other flexible material to allow for radial expansion/contraction in case the cement basket is run through a non-uniform annulus. The cement basket 110 further includes petals 114 supporting the barrier 112, where the petals 114 may create a flexible cage-like structure spanning the annulus 104.

The cement basket 110 may be positioned above (uphole) a lost circulation zone 105 in the formation around the well 101 that cannot support a full column of cement. For example, the lost circulation zone 105 may be a highly porous or weak formation. In such cases, when cement 130 is pumped into the cement basket 110 (from an uphole injection point), the cement basket 110 may support and hold the cement slurry from being lost into the lost circulation zone 105.

Conventional cement baskets are designed to be flexible, allowing for radial expansion/contraction within a well annulus. By providing the cement baskets with radial flexibility, the cement baskets may expand within and pass through uneven well walls.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to downhole tools with a support ring having an annular-shaped body, a thickness measured between an uphole side of the body and an opposite downhole side of the body, an extension distance measured between an inner diameter of the body and an outer diameter of the body, and an opening formed through the thickness of the body. A flapper valve or other one way valve may be disposed in each opening formed through the support ring to limit flow through the support ring in a direction from the downhole side of the body to the uphole side of the body.

In another aspect, embodiments disclosed herein relate to methods that include providing a casing string in a wellbore, wherein the casing string is made of multiple casing joints axially connected together, including a unidirectional rigid cement (URC) basket. The URC basket includes a first casing joint having a tubular body and a support ring positioned along the tubular body, wherein the support ring has an annular-shaped body extending radially outward from the tubular body and multiple openings formed through a thickness of the support ring. A flapper valve is provided in each of the multiple openings. The methods may further include pumping cement through the casing string and into an annulus formed between the casing string and the wellbore in a first cementing stage and pumping the cement through the annulus from a location uphole of the URC basket in a second cementing stage.

Other aspects and advantages will be apparent from the following description and the appended claims.

DETAILED DESCRIPTION

Embodiments disclosed herein relate generally to unidirectional rigid cement (URC) baskets. URC baskets according to embodiments of the present disclosure may be used for cementing operations in well construction, where the URC basket may be provided along a casing string to be positioned and cemented in place within a well to line the well.

When a casing string having a URC basket according to embodiments of the present disclosure is provided in a well, the URC basket may extend across the annulus formed between the casing string and well wall. Flapper valves or other one-way valves provided in the URC basket may allow one-way flow through the annulus, across the URC basket, which may allow for simplified cementing operations.

For example, when installing a casing string having a URC basket, flapper valves provided in the URC basket may allow one-way uphole flow (e.g., cement flowing from the end of the casing string and uphole through the annulus; or fluids flowing uphole as the casing string is lowered into the well) and prevent downhole flow through the URC basket. As used herein, "uphole" refers to a direction from the bottom of a well toward the surface of the well, and "downhole" refers to the opposite direction, from the surface of the well toward the bottom of the well.

Figure 1:
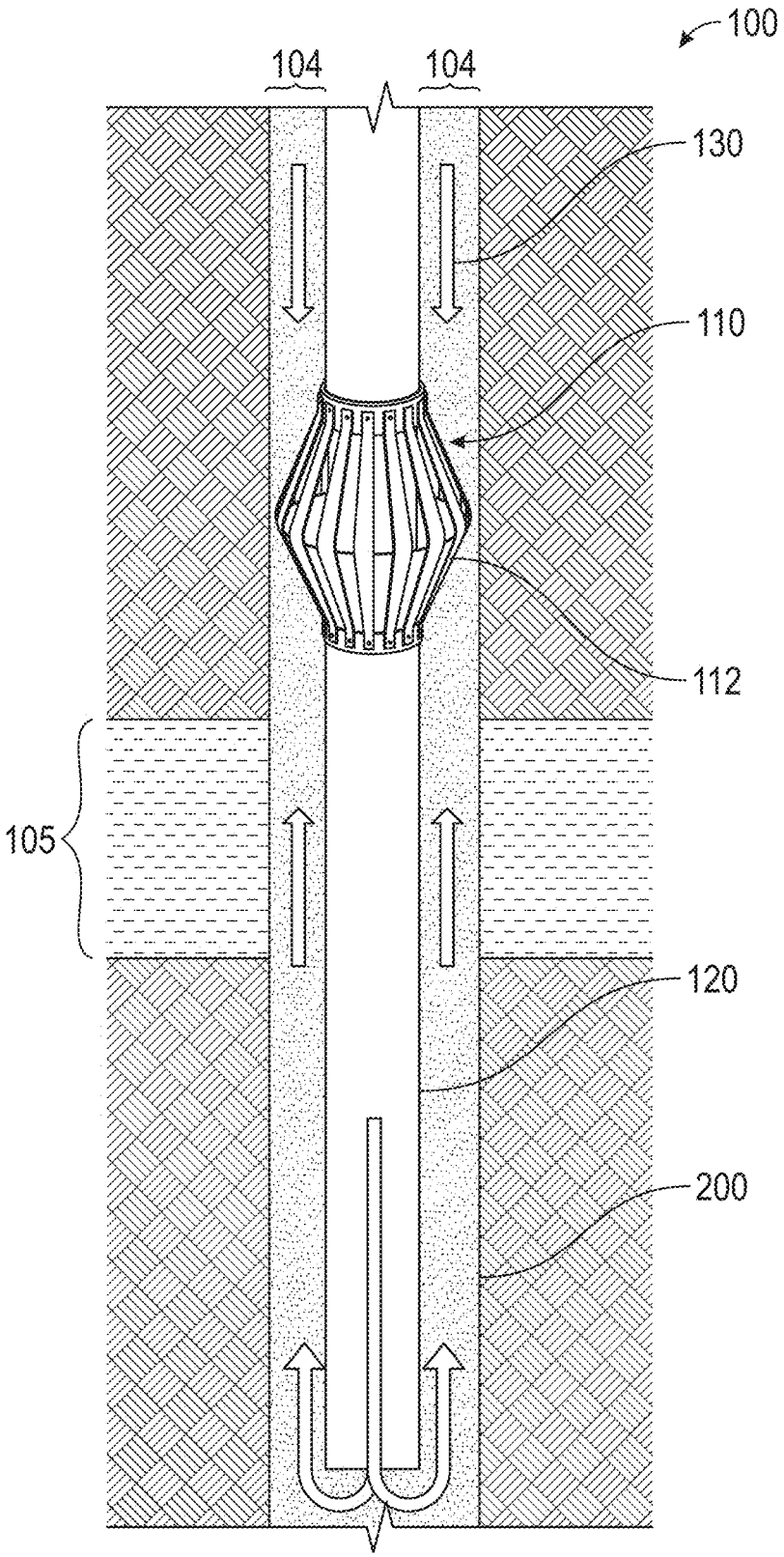
FIG. 1 (Prior Art)
FIG. 1 shows a well system using a conventional cement basket for a cementing operation.
Figure 2:
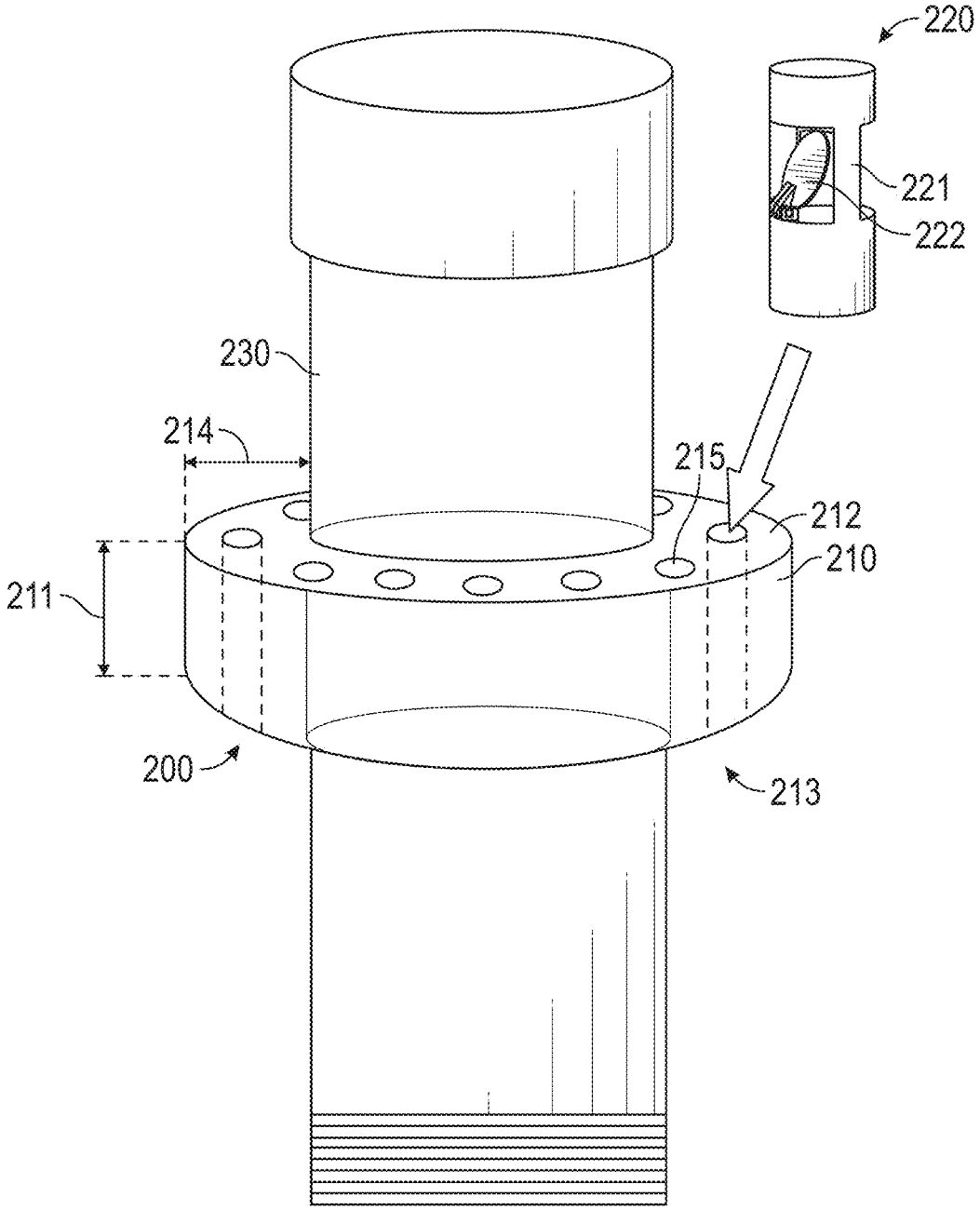
FIG. 2 shows a downhole tool according to embodiments of the present disclosure.

FIG. 2 shows an example of a URC basket 200 according to embodiments of the present disclosure. The URC basket 200 is made of a support ring 210 having an annular-shaped body. The support ring 210 has a thickness 211 measured between an uphole side 212 of the body and an opposite downhole side 213 of the body, where the uphole side 212 may refer to the side of the body that faces in the direction towards the surface of a well, and the downhole side 213 may refer to the side of the body that faces in the direction towards the bottom of the well, when the URC basket 200 is installed in the well. The support ring 210 also has an extension distance measured between an inner diameter of the body and an outer diameter of the body. The URC basket may be rigid, having a flexural strength sufficient to hold a column of cement above it. For example, a URC basket may be formed of steel. Additionally, the support ring 210 may be a solid body (where the material forming the support ring extends the entire thickness of the body) or may be a hollow body (where the body is made of integrally formed or connected together support structures that together form the structure of the body).

The support ring of a URC basket may have at least one opening formed through its thickness for receiving a flapper valve. Such openings may extend entirely through the support ring, fluidly connecting the uphole side of the body to the downhole side of the body, in order to provide flow passages through the support ring. Flapper valves or other one-way valves installed in such openings may restrict the flow through the openings to unidirectional flow.

For example, as shown in FIG. 2, multiple openings 215 are circumferentially spaced around the body, where each opening 215 extends through the entire thickness of the body. In one or more embodiments, the openings 215 may be equally spaced around the support ring. Each opening 215 may have a flapper valve 220 provided therein, where the flapper valve 220 includes a flapper 222 that is rotatable about an axis perpendicular to the thickness 211 of the body when installed in the support ring 210. In the embodiment shown, the flapper 222 is assembled to a separate valve body 224, where the valve body 224 is then fixed within an opening 215. However, in some embodiments, a flapper may be assembled directly to an opening, thereby integrally forming the flapper valve in the opening.

Figure 3:
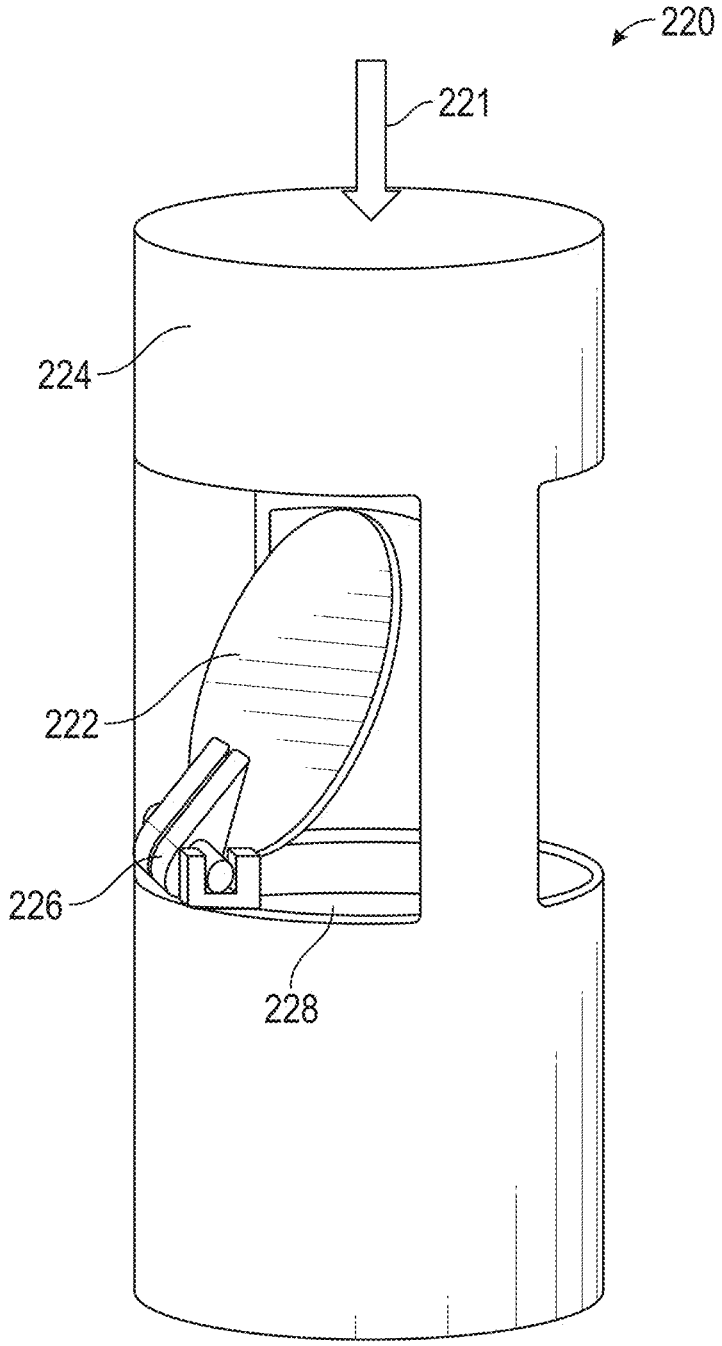
FIG. 3 shows an example of a flapper valve for use in the downhole tool of FIG. 2.

FIG. 3 shows a detailed view of the example flapper valve 220 shown in FIG. 2. As shown, the flapper valve 220 has a valve body 224 with a flow path 221 extending axially therethrough. A hinge 226 rotatably connects the flapper 222 along the flow path 221 inside the valve body 224. Particularly, the flapper 222 is rotatably connected along the flow path 221 such that rotation of the flapper 222 to a closed configuration completely blocks the flow path 221. A valve seat 228 is provided along an inner surface of the valve body 224, where the valve seat 228 protrudes inward, thereby narrowing the inner diameter of the flow path 221. When the flapper 222 rotates within the flow path 221 and a portion of the flapper 222 contacts the valve seat 228, the valve seat 228 may hold the flapper 222 in the closed configuration and prevent full rotation of the flapper 222 through the flow path 221.

In the embodiment in FIG. 3, the hinge 226 is provided along a side wall of the valve body 224, such that the connected flapper 222 pivots from the side wall between open and closed configurations. In other embodiments, a flapper may be pivoted around a hinge (pivot point) that extends through the diameter of the flapper. In such embodiments, the flapper may be pivoted vertically to be generally parallel with the length of the flow path 221 in an open configuration, and rotated to a horizontal position to be perpendicular to the length of the flow path 221 in a closed configuration. Various types of flapper valves and flapper pivot connections may be used to rotatably mount a flapper in a flapper valve, where in the open configuration, the flapper is rotated to allow flow through the flapper valve flow path, and in the closed configuration, the flapper extends across the entire cross-sectional area of the flapper valve flow path to block flow through the flow path.

In embodiments having a flapper valve formed integrally with an opening through the support ring, a flapper may be rotatably connected to an inner surface of the opening via a hinge. Further, in such embodiments, one or more valve seats may be provided along the inner surface of the opening, where the valve seat extends into the opening, thereby narrowing the inner diameter of the opening at the axial position of the valve seat. The flapper may be sized and positioned along the opening, such that when the flapper valve is in a closed configuration, a portion of the flapper contacts the valve seat and the flapper seals the flow path formed through the opening.

According to embodiments of the present disclosure, a support ring may be integrally formed with or mounted to a casing joint to form the URC basket. As used herein, a casing joint may refer to a tubular section that may be used to form part of a casing string, and may include casing connections, pup joints, and longer sections of casing tubing being connected. In the industry, casing pup joints, sometimes called saver subs, refer to short lengths of casing tubing that may be used to adjust the length required of the casing string. Pup joints may have the same size in diameter, threads, and grade as the longer casing tubing joints forming a casing string, where only the length is different. For example, the length of a pup joint may vary from about 1-20 ft, whereas a typical casing tubing joint may have a length of 30 ft or more.

As shown in FIG. 2, the support ring 210 is provided on a casing joint 230. In some embodiments, the support ring 210 may be fixed along an outer surface of the casing joint 230, wherein the body of the support ring extends radially outward the extension distance 214 from the outer surface of the casing joint 230. In such embodiments, the support ring may be fitted around the outer surface of the casing joint, for example, by concentrically sliding the support ring around an axial end of the casing joint to an axial position along the length of the casing joint and then fixing the support ring at the axial position (e.g., via welding or clamp). In some embodiments, the support ring may be integrally formed with the casing joint.

URC baskets according to embodiments of the present disclosure may include a casing joint having threaded connection ends, which may be threadably connected to other casing joints to form a casing string. For example, as shown in FIG. 2, the casing joint 230 may have a box end 232 (female connection with threads formed around the inner surface) at a first axial end and a pin end 234 (male connection with threads formed around the outer surface) at an opposite axial end. However, other types and combinations of connection ends may be provided at the opposite axial ends of a URC basket (e.g., two box ends or two pin ends).

A URC basket according to embodiments of the present disclosure may be connected to casing joints in an end-to-end manner to form a casing string. The casing string with the URC basket may be lowered into a well and cemented in place to line the well. The well may be lined with a previously installed casing, where the URC basket may be run through and installed inside the previous casing (rather than an open borehole in a well). For example, a URC basket according to embodiments of the present disclosure may be provided along an upper portion of a surface casing string, where the upper portion of the surface casing string and URC basket may be installed within and axially overlapping with an installed conductor string.

In one or more embodiments, a first, primary cementing stage may be conducted to cement the annulus between the well wall (e.g., a previously installed casing forming the well wall) and the casing string downhole of the URC basket, while a second, top cementing stage may be conducted to cement the annulus uphole of the URC basket. In primary cementing stages, cement may be pumped through the casing string to enter the annulus at the bottom of the casing string. In top cementing stages, cement may be pumped from tubing entering the annulus from the surface of the well and/or pumped through stage cementing tools (also referred to as differential valve (DV) tools) located uphole of the URC basket.

In some embodiments, a casing string with the URC basket may be lowered into a well having one or more loss zones, where the URC basket may be positioned along the casing string such that the URC basket is uphole of the loss zone(s). Once the casing string is in position in the well, the casing string may be cemented in place using a first cementing stage to cement along and/or downhole of the loss zone(s) and a second, top cementing stage to cement uphole of the loss zone(s).

By using a URC basket according to embodiments of the present disclosure to form a casing string, the URC basket may be used to hold a relatively heavier cement column than would have otherwise been possible with conventional cement baskets. For example, conventional cement baskets, which have traditionally included a flexible basket portion supported by a flexible cage-like structure, are limited in their depth of placement along a casing because the same design that allows for the basket's flexibility also increases the likelihood of breakage under a high hydrostatic load of a column of cement slurry. Because a URC basket according to embodiments of the present disclosure can hold a relatively higher hydrostatic load from a column of cement slurry, a top cementing job may be performed with the URC basket using a reduced amount of cementing stage intervals, and thus a reduced amount of associated stage cementing tools, thereby reducing well construction complexity and rig time.

Figure 4:
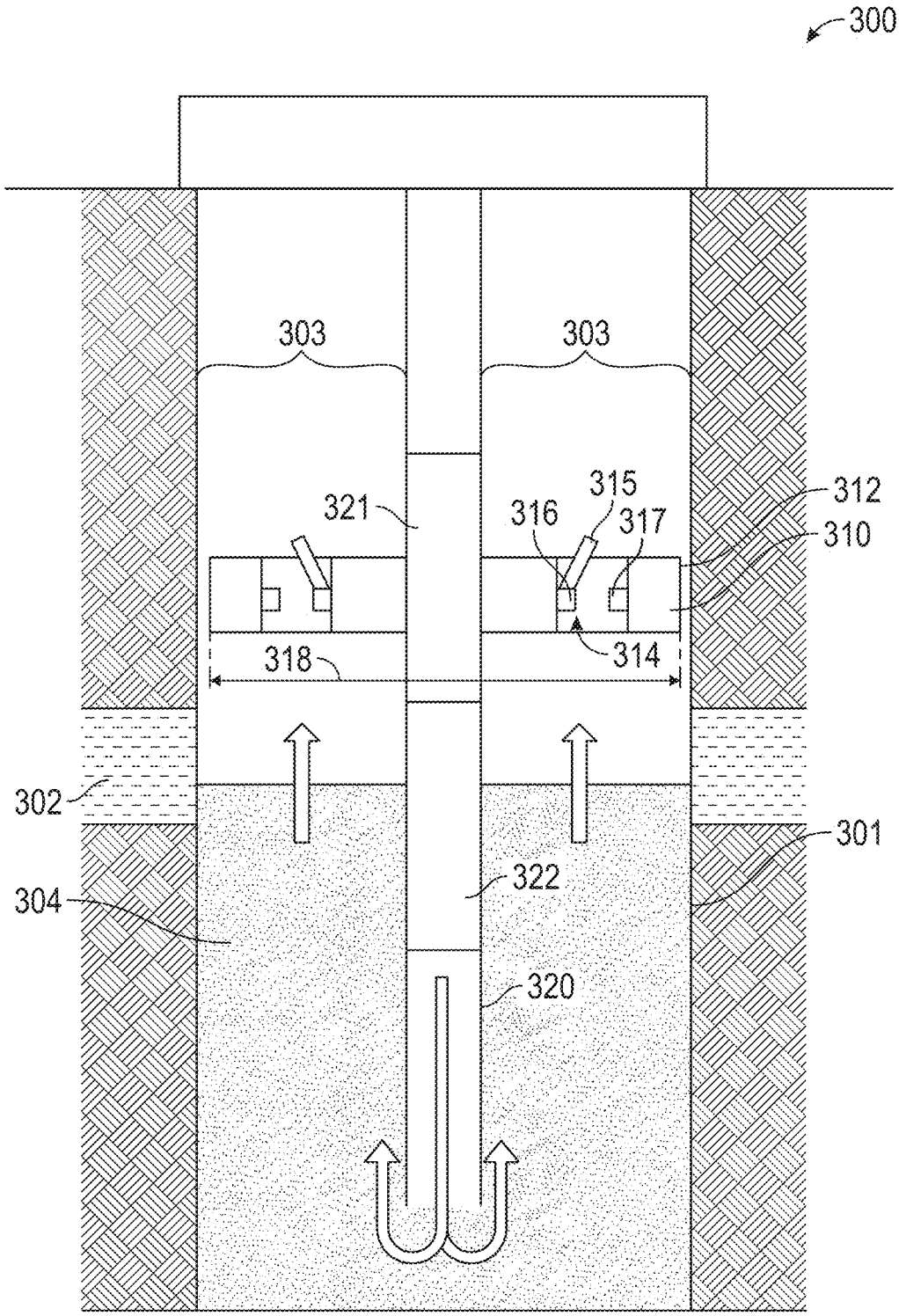
FIG. 4 shows a first cementing stage in a well system according to embodiments of the present disclosure.
Figure 5:
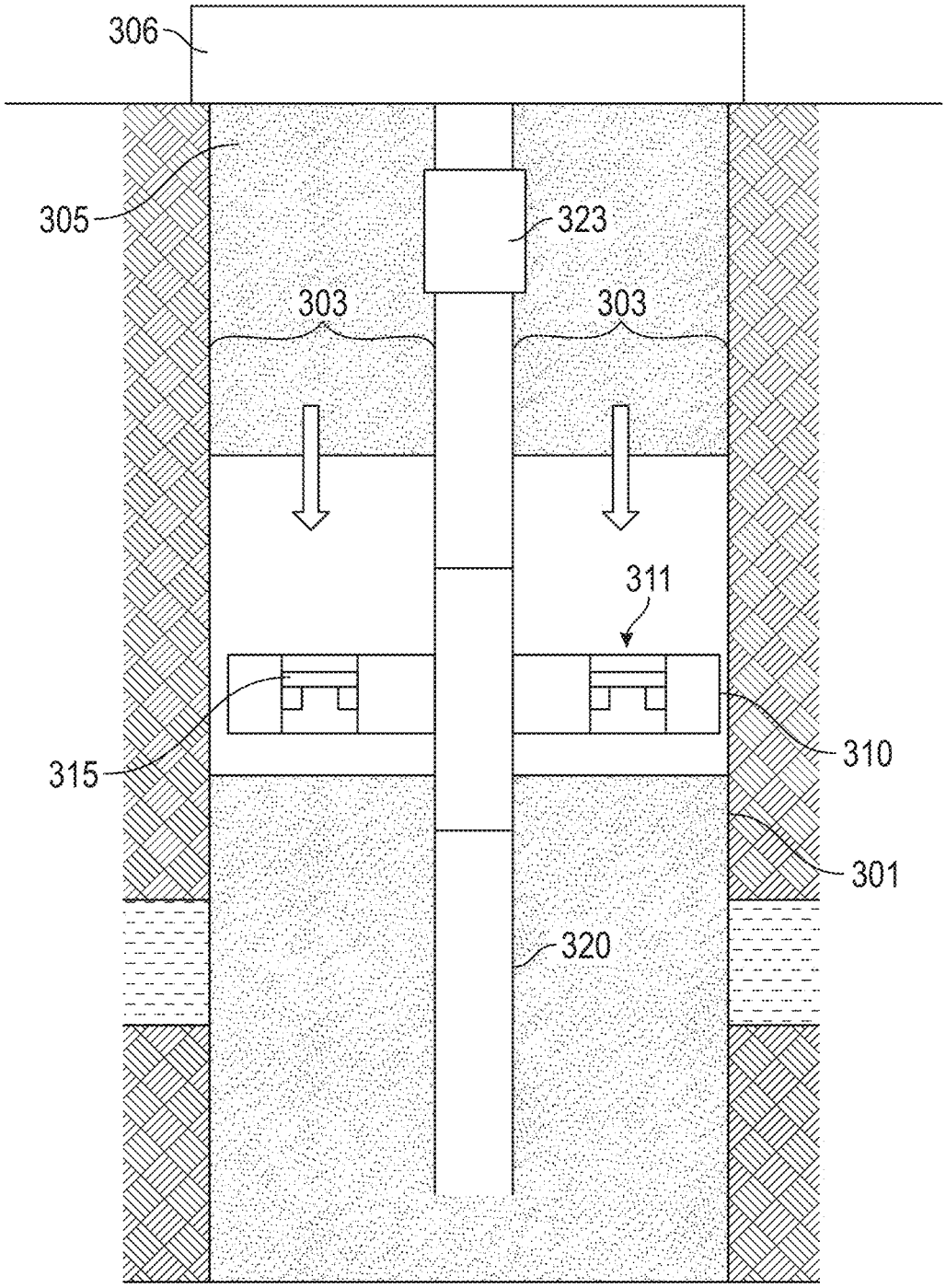
FIG. 5 shows a second, top cementing stage of a well system according to embodiments of the present disclosure.

FIGS. 4 and 5 show an example of a well construction system 300 using a URC basket 310 according to embodiments of the present disclosure and associated methods for lining a well 301 with a casing string 320. Particularly, FIG. 4 shows a first cementing stage of the well construction, and FIG. 5 shows a second, top cementing stage of the well construction. The relative sizes of the components shown in FIGS. 4 and 5 are not shown to scale, but instead, are drawn to show relevant details to the well construction.

The well construction may include assembling a series of casing strings into a drilled borehole to line the well. Casing strings are made of long tubular bodies connected together in an end-to-end fashion and may be manufactured from plain carbon steel, aluminum, titanium, fiberglass and other materials. Casing strings may be categorized as conductor casing, surface casing, intermediate casing, liner string, and production casing. Generally, a conductor casing string may be the first installed and cemented casing string in the well construction and has the largest diameter. Surface casing, having a diameter less than the conductor casing, may then be installed and cemented through the conductor casing, extending from the surface of the well to a depth farther than the conductor casing. Intermediate casing and/or liner strings have smaller diameters than surface casing and may be installed through surface casing. Intermediate casing may be cemented into place, whereas liner strings may be hung from a previously installed casing string without cementing. URC baskets according to embodiments of the present disclosure may be installed along casing strings that are cemented into a well, including, for example, conductor casing, surface casing, and intermediate casing strings. In FIGS. 4 and 5, a single casing string 320 is being installed in the well 301, where the well wall may be formed of a previously installed casing. In one or more embodiments, the well wall may further include an open borehole portion downhole from the previously cased wall.

As shown in FIGS. 4 and 5, the URC basket 310 is axially connected to multiple additional casing joints 322 to form the casing string 320. The URC basket 310 includes a support ring 312 extending outwardly from a first casing joint 321. The support ring 312 may be integrally formed with the first casing joint 321 or attached to the first casing joint 321.

In some embodiments, the URC basket 310 may be formed with the first casing joint 321 having corresponding connection ends with the other casing joints 322 in the casing string 320. In some embodiments, crossovers can be used to connect the URC basket with the other casing joints 322 in the casing string 320. For example, an upper crossover joint may be directly connected to an upper axial end of the URC basket, and a lower crossover joint may be directly connected to a lower axial end of the URC basket. The ends of the upper and lower crossover joints opposite the URC basket may be connected to casing joints 322 of the casing string 320. As used herein, a crossover (also referred to as a crossover sub in the industry) refers to a one-piece tubular section having threaded axial connection ends used to connect components with different sizes or thread types. For example, when a URC basket has a threaded connection at its axial end that does not connect with the threaded connection end of another casing joint 322 in the casing string 320, a crossover may be used to connect the two components, where the crossover has threaded axial connection ends that on one side connects with the URC basket threaded connection and on the opposite side connects with the threaded connection end of the casing joint 322.

The support ring 312 of the URC basket 310 has multiple openings 314 formed through its thickness and extending parallel with the central axis of the URC basket 310. Accordingly, when the casing string 320 is inserted into the well 301, the openings 314 may extend generally parallel with the length of the well 301.

A flapper valve is provided in each of the openings 314, where each flapper valve includes a flapper 315 pivotably connected inside the opening 314 via a hinge 316 and a valve seat 317 for holding the flapper 315 in a closed configuration. The valve seat 317 extends partially into the flow path formed through the flapper valve and may be provided along the inner surface of the opening when the flapper valve is integrally formed with the opening or may be provided along the inner surface of a valve body with the flapper valve is separately configured and installed in the opening. Further, the valve seat may extend at least partially around, and in some designs entirely around, the inner surface of the flapper valve. The flapper 315 may be pivotably connected in the flapper valve in a configuration where at least a portion of the flapper 315 remains axially above the valve seat 317 in both the open and closed configurations. For example, in the embodiment shown in FIGS. 4 and 5, an edge of the flapper 315 is connected in the flapper valve by a hinge 316 located axially above the valve seat 317. In such embodiments, the entire flapper 315 remains axially above the valve seat 317 in both the open and closed configurations. In embodiments where the flapper is rotatable about a hinge or pivot point extending through the flapper (e.g., across its diameter), a portion of the flapper may remain axially above the valve seat in both the open and closed configurations. Further, the flapper 315 is pivotably connected in the flapper valve to be rotated in an uphole direction when the URC basket 310 is installed along a casing string 320 in a well 301, where a portion of the flapper 315 contacting the valve seat 317 in the closed configuration may rotate toward the surface of the well to move to the open configuration.

The URC basket 310 may be sized to fit through the well 301 as the casing string 320 is lowered into the well 301. For example, the support ring 312 of the URC basket 310 may have an outer diameter 318 that ranges between 90 and 99 percent of the inner diameter of the well wall. In one or more embodiments, the URC basket 310 is fitted within a previously installed casing in the well, where the outer diameter 318 of the URC is less than the drift diameter (the inside diameter that the pipe manufacturer guarantees per specifications) of the previously installed casing. The support ring 312 may also circumferentially extend around the entire circumference of the casing string 320, such that the support ring 312 extends across the entire cross-sectional area of the annulus 303 formed between the casing string 320 and the well wall. In such manner, the URC basket 310 may centralize the casing string within the well 301.

When the casing string 320 is lowered into the well 301, fluids may circulate through the well, which may push the flappers 315 in the flapper valves to an open configuration (shown in FIG. 4), thereby allowing the fluids to continue circulating as the casing string 320 is moved through the well 301. In one or more embodiments, the casing string 320 may be positioned in the well 301 such that the URC basket 310 is uphole from one or more loss zones 302 interfacing the well 301. A loss zone 302 may include portions of the formation having cracks, fissures, or increased porosity, through which fluids circulating in the well may flow into the formation. A loss zone may be identified, for example, by monitoring the flow rate and/or amount of drilling fluid returning to the surface of the well 301 while drilling the well, where a measured decrease in the flow rate and/or amount of returning drilling fluid indicates the loss zone. The measured decrease in the flow rate and/or amount of returning drilling fluid indicating a loss zone may be preselected by operators or designers of the well.

As shown in FIG. 4, after the casing string 320 is positioned the casing string, a cement slurry 304 may be pumped through the casing string 320 and into the annulus 303 formed between the casing string 320 and the well wall in a first cementing stage, also referred to as a primary cement job. As used herein, a "cement slurry" refers to cement in its uncured, pumpable state. The cement composition may include, for example, Portland cement (including lime, silica, alumina, and iron oxide), water, and various types of optional additives, such as retarders and viscofiers.

During the first cementing stage, as cement is pumped through the casing string 320 and into the annulus 303, the pressure at the bottom of the well and in the annulus increases. The pressure increase in the annulus 303, downhole of the URC basket 310, causes the flapper valves in the support ring 312 to move from a closed configuration to an open configuration. Particularly, the increased pressure may push the flappers 315 in the flapper valves in an uphole direction, thereby opening the flapper valves and allowing fluid flow through the flapper valves to an uphole side of the URC basket 310. When the pressure differential between the uphole and downhole sides of the URC basket 310 equalizes or when the uphole pressure relative to the downhole pressure increases, the increased uphole pressure may push the flappers 315 back to a closed configuration. In one or more embodiments, a spring force on the hinge 316 of the flapper valve may be selected based on a downhole pressure selected as a condition for opening the flapper valve.

In one or more embodiments, flapper valves on URC baskets have a default position to stay in the closed configuration and may be activated to the open configuration when fluid circulation is initiated (e.g., during a primary cement job) or due to surge pressures associated with running the casing string to the bottom of the well. In such manner, the URC basket may allow unidirectional fluid flow (e.g., mud/slurry flow) through the annulus from the bottom of the well toward the surface of the well with a minimum equivalent circulating density (ECD) effect on the bottom of the well, while opposite flow from the surface toward the bottom of the well is prevented by the flapper valves. ECD refers to the effective density of a circulating fluid through the well (e.g., cement slurry or circulating fluids as the casing string is moved through the well) resulting from the sum of the hydrostatic pressure imposed by the fluid column and the friction pressure. In one or more embodiments, the design of the URC basket 310 (e.g., the amount and size of flapper valves provided through the support basket and/or a spring force of the hinge for opening the flapper valves) may be selected to minimize ECD and the surge effect while running in and cementing the casing string 320.

Further, the size, shape, and/or rigidity of URC baskets and the flapper valves provided therein may be selected such that the URC basket centralizes the casing string on which it is connected and hold cement slurry in place both while the cement is setting up and after the cement slurry has cured.

In one or more embodiments, during a primary cement job, the cement slurry 304 may reach the URC basket 310, whereupon cement may push open the flapper valves and flow through the URC basket 310 to an uphole side of the URC basket 310. Cement flowing past the uphole side of the URC basket 310 may be prevented from flowing back to the downhole side of the URC basket by automatic closure of the flapper valves. In some embodiments, the cement slurry 304 in a primary cement job may not reach the URC basket 310 through the annulus 303. For example, when the cement slurry 304 flows through an annulus 303 interfacing with a loss zone 302, cement may flow into and be lost into the loss zone of the well formation.

When the cement slurry 304 in the primary cement job does not reach a desired axial location along the annulus (e.g., when the cement slurry does not reach the URC basket 310 or when the cement slurry does not reach a selected location above the URC basket), a second cementing stage may be performed, referred to as a top cement job, where a cement slurry is pumped through the annulus from the surface of the well or through one or more stage cementing tools positioned along the casing string uphole from the URC basket.

For example, FIG. 5 shows an example of a second, top cementing stage. During the top cementing stage, a cement slurry 305 having the same or different composition as the cement slurry 304 used in the primary cement job is pumped through the annulus 303 from a location uphole of the URC basket 310.

In one or more embodiments, the cement slurry 305 may be introduced into the annulus 303 at an uphole location from the URC basket 310 by inserting an injection tubing into the annulus 303 from surface equipment 306 at the surface of the well 301. In some embodiments, the cement slurry 305 may be introduced into the annulus 303 at an uphole location from the URC basket 310 through one or more stage cementing tools 323. For example, as shown in FIG. 5, the casing string 320 may include a single stage cementing tool 323 positioned uphole from the URC basket 310. In other embodiments, more than one stage cementing tool may be provided along a casing string for introducing cement in a top cement job.

By using URC baskets according to embodiments of the present disclosure, the use of stage cementing tools for top cementing jobs may be reduced or eliminated. Thus, while the system shown in FIG. 5 includes a single stage cementing tool 323 positioned uphole from the URC basket 310 providing a cement flow path during the top cementing stage, using URC baskets according to embodiments may allow for top cementing job systems in which no stage cementing tools are used. For example, in a case of total loss or partial loss in a well, a top cementing job may be performed without the use of a stage cementing tool, where cement may be pumped in the annulus 303 from the surface of the well (e.g., at an opening end of the well) in the top cementing job. In some embodiments, cement may be pumped in the annulus from the surface of the well in a top cementing job using one or more flow paths formed through the wellhead equipment in fluid communication with the annulus at the opening end of the well (proximate the surface).

A stage cementing tool may refer to a generally tubular assembly of components that may be axially assembled inline with a casing string (e.g., via threaded connections at opposite axial ends of the assembly). Stage cementing tools may also include one or more ports that fluidly connect an inner flow passage through the stage cementing tool with an outer environment (e.g., the annulus formed between the casing string and the well). Port(s) in a stage cementing tool may be closed while the tool is run in hole and selectively opened, e.g., by moving a sleeve covering the port(s) or by activating a differential valve provided in the tool. When the port(s) in a stage cementing tool is opened, cement flowing through the connected casing string may exit through the port(s) and into a surrounding well annulus. Stage cementing tools used in embodiments according to the present disclosure may include stage cementing tools known and available in the art.

During the top cementing stage, as the cement slurry 305 is introduced into the annulus 303 uphole of the URC basket 310, the annulus pressure uphole of the URC basket 310 may increase. The increase in annulus pressure uphole of the URC basket 310 may be used to close the flapper valves 311 in the URC basket 310. The cement slurry 305 may land on the uphole side of the URC basket 310 (covering the closed flapper valves 311) and fill the annulus to form a column of cement supported by the URC basket 310.

Upon completing one or more cement jobs to cement the casing string 320 in the well 301, the URC basket 310 may remain fixed along the casing string 320 and cemented in place. In one or more embodiments, additional casing may be installed through the cemented casing string 320.

One or more of the following advantages may be realized using URC baskets according to embodiments of the present disclosure. For example, unlike conventional cement baskets, URC baskets according to embodiments of the present disclosure include flapper valves. The flapper valves allow amplified use in following major cases: 1) when partial losses are recorded during drilling or partial losses are recorded during a casing run; and 2) when full returns are observed during drilling, but there is risk of partial/total losses during cementing. In both cases, single stage primary cementing may be planned. If the cement slurry from the primary cement job reaches the surface of the well annulus at the end of the primary cement job, then a URC basket provided along the casing string may not be utilized for top cementing, and the URC basket is merely cemented in place during the primary cement job. However, if total losses or partial losses occur during a primary cement job, and the cement slurry in the primary cement job does not reach the planned annulus location, then a top cement job can be executed utilizing the URC basket.

The disclosed URC baskets and associated systems and methods of their use may reduce use of two stage cementing with stage cementing tools, e.g., a stage collar, which are typically used to cement multiple sections behind the same casing string, or to cement a critical long section in multiple stages. Thus, by using URC baskets according to embodiments of the present disclosure, well construction complexity may be reduced, rig time for top jobs may be minimized, and well integrity may be improved by increasing cement bonding in shallow parts around a casing string above total loss zones.

Further, several drawbacks have been observed with conventional cement baskets. One such major drawback includes the potential to induce partial or total losses when primary cementing is initiated with full returns. Restriction in the annulus due to a conventional cementing basket can create extra ECD at the bottom of the well, which may initiate cracks and losses in weak formations below the conventional cementing basket. However, by using URC baskets according to embodiments of the present disclosure, which include flapper valves allowing for unidirectional fluid flow in a direction from the bottom of the well to the surface of the well, ECD at the bottom of the well may be minimized, resulting in lowered incidence and likelihood of crack initiations from the cementing job.

Additionally, conventional cement baskets are typically flexible and cannot support high hydrostatic loads from a top job cement column. Thus, conventional cement baskets are limited on their depth of placement, and multiple cement baskets may be needed for larger top cement jobs. However, by using URC baskets according to embodiments of the present disclosure, which have a rigid structure, the URC basket may hold relatively larger cement columns when compared with conventional cement baskets. Thus, a reduced amount of URC baskets may be used for larger top cement jobs when compared with conventional cement basket usage.

Accordingly, URC baskets according to embodiments of the present disclosure may allow successful top cement jobs with minimum attempts to fill up the annulus volume with cement slurry to the surface when a primary cement job is executed under total loss circulation. Although efficiency of a top cement job may be improved using a URC basket according to embodiments of the present disclosure, in some cases, several top cement job attempts may be needed to bring a cement slurry to the surface of the annulus.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A downhole tool, comprising:

a support ring provided on a casing joint, the support ring comprising:

an annular-shaped body;

a thickness measured between an uphole side of the body and an opposite downhole side of the body;

an extension distance measured between an inner diameter of the body and an outer diameter of the body;

wherein the body of the support ring extends radially outward the extension distance from an outer diameter of the casing joint, an opening formed through the thickness of the body; and a flapper valve disposed in the opening, wherein the flapper valve comprises a flapper rotatable about an axis perpendicular to the thickness of the body.

2. The downhole tool of claim 1, further comprising:

multiple additional openings; and multiple additional flapper valves, wherein each of the multiple additional flapper valves is disposed in each of the multiple additional openings, and wherein the multiple additional openings are circumferentially spaced around the body.

3. The downhole tool of claim 1, wherein the flapper valve further comprises:

a valve body having a flow path extending axially therethrough;

a hinge rotatably connecting the flapper along the flow path in the valve body; and a valve seat provided along an inner surface of the valve body, wherein a portion of the flapper contacts the valve seat when the flapper valve is in a closed configuration, and wherein the valve body is fixed within the opening.

4. The downhole tool of claim 1, wherein the flapper is rotatably connected to an inner surface of the opening via a hinge.

5. The downhole tool of claim 4, wherein the inner surface of the opening comprises a valve seat extending into the opening, and wherein a portion of the flapper contacts the valve seat when the flapper valve is in a closed configuration.

6. The downhole tool of claim 1, wherein the support ring is fixed along an outer surface of the casing joint.

7. The downhole tool of claim 1, wherein the support ring is integrally formed with the casing joint.

8. A system, comprising, a casing string extending through a wellbore, wherein the casing string is made of multiple casing joints axially connected together, the casing string comprising:

the downhole tool of claim 1.

9. The system of claim 8, wherein the multiple casing joints further comprise a stage cementing tool, wherein the stage cementing tool is positioned uphole from the casing joint of the downhole tool of claim 1.

10. The system of claim 8, wherein the outer diameter of the support ring ranges between 90 and 99 percent of a diameter of the wellbore.

11. The system of claim 8, wherein the multiple casing joints further comprise an upper crossover joint connected to an upper axial end of the casing joint and a lower crossover joint connected to a lower axial end of the casing joint of the downhole tool of claim 1.

12. A method, comprising:

providing a casing string in a wellbore, wherein the casing string is made of multiple casing joints axially connected together, the multiple casing joints comprising:

a unidirectional rigid cement (URC) basket, comprising:

a first casing joint having a tubular body; and a support ring positioned along the tubular body, wherein the support ring comprises:

an annular-shaped body extending radially outward from the tubular body;

multiple openings formed through a thickness of the support ring; and multiple flapper valves, wherein each of the multiple flapper valves is provided in each of the multiple openings;

pumping cement through the casing string and into an annulus formed between the casing string and the wellbore in a first cementing stage; and pumping the cement through the annulus from a location uphole of the URC basket in a second cementing stage.

13. The method of claim 12, wherein the multiple casing joints further comprises a single stage cementing tool, wherein the stage cementing tool is positioned uphole from the URC basket.

14. The method of claim 12, wherein the multiple openings are equally spaced around the support ring.

15. The method of claim 12, further comprising:

during the first cementing stage, using a first pressure increase in the annulus downhole of the support ring to open the flapper valves; and during the second cementing stage, using a second pressure increase in the annulus uphole of the support ring to close the flapper valves.

16. The method of claim 12, wherein the second cementing stage comprises pumping the cement through the annulus from an opening end of the wellbore.

* * * * *